US008075188B2

(12) United States Patent
Plunkett et al.

(10) Patent No.: US 8,075,188 B2
(45) Date of Patent: Dec. 13, 2011

(54) FLEXIBLE LINER FOR FIBC OR BAG-IN-BOX CONTAINER SYSTEMS WITH IMPROVED FLEX CRACK RESISTANCE

(75) Inventors: James Plunkett, Wareham, MA (US); Joseph Sullivan, Plymouth, MA (US)

(73) Assignee: CDF Corporation, Plymouth, MA (US)

( * ) Notice: Subject to any disclaimer, the term of this patent is extended or adjusted under 35 U.S.C. 154(b) by 987 days.

(21) Appl. No.: 11/361,691

(22) Filed: Feb. 24, 2006

(65) Prior Publication Data

US 2007/0201774 A1 Aug. 30, 2007

(51) Int. Cl.

| | |
|---|---|
| ***B65D 33/02*** | (2006.01) |
| ***B65D 33/00*** | (2006.01) |
| ***B65D 30/08*** | (2006.01) |
| ***B65D 33/16*** | (2006.01) |

(52) U.S. Cl. ..... 383/119; 383/105; 383/109; 383/116; 383/67

(58) Field of Classification Search ..... 383/903, 383/119, 116, 109, 105, 110–113, 106, 67; 220/62.1; 254/93 HP; 405/289; 206/522, 206/524.2

See application file for complete search history.

(56) References Cited

U.S. PATENT DOCUMENTS

| | | | | |
|---|---|---|---|---|
| 875,780 | A | | 1/1908 | Coats |
| 931,808 | A | | 8/1909 | Smith |
| 1,120,058 | A | | 12/1914 | Hutto |
| 1,132,000 | A | | 3/1915 | Dight |
| 1,135,866 | A | | 4/1915 | Turner |
| 2,083,776 | A | | 6/1937 | Ferguson |
| 2,155,057 | A | * | 4/1939 | Moore ..... 206/459.5 |
| 2,239,156 | A | | 4/1941 | Davis |
| 2,260,064 | A | * | 10/1941 | Stokes ..... 53/415 |
| 2,333,587 | A | | 11/1943 | Salfisberg |
| 2,339,156 | A | | 1/1944 | Davis |
| 2,446,308 | A | | 8/1948 | Smith |
| 2,638,263 | A | * | 5/1953 | Jesnig ..... 383/103 |
| 2,720,998 | A | | 10/1955 | Potter |
| 2,738,796 | A | | 3/1956 | Chadwick |
| 2,757,669 | A | | 8/1956 | Gewecke et al. |
| 2,799,314 | A | | 7/1957 | Dreyer et al. |
| 794,125 | A | | 4/1958 | Walter Frederick Locke |
| 2,930,423 | A | | 3/1960 | Cunningham |
| 2,950,037 | A | | 8/1960 | Orsini |

(Continued)

FOREIGN PATENT DOCUMENTS

| | | |
|---|---|---|
| CA | 1 159 379 | 12/1983 |

(Continued)

OTHER PUBLICATIONS

Author unknown, "TNT: TNT Liquid Discharge Roller Arm," 2 pgs., date unknown.

(Continued)

*Primary Examiner* — Jes F Pascua
(74) *Attorney, Agent, or Firm* — Dorsey & Whitney LLP; Brett A. Klein, Esq.

(57) ABSTRACT

A liner for use in a bulk container is provided. The liner comprises a first flexible portion, a second flexible portion, a first seal joining the first and second portions, a second seal joining the first and second portions, a third seal joining the first and second portions, and a fourth seal joining the first and second portions. The first portion is a better barrier than the second portion.

20 Claims, 5 Drawing Sheets

U.S. PATENT DOCUMENTS

| | | | | | |
|---|---|---|---|---|---|
| 2,951,628 | A | | 9/1960 | Grussen | |
| 2,956,839 | A | | 10/1960 | Hermanns | |
| 2,973,119 | A | | 2/1961 | Parker | |
| 3,006,257 | A | | 10/1961 | Orsini | |
| 3,039,656 | A | | 6/1962 | Wentz | |
| 3,044,515 | A | | 7/1962 | Eades | |
| 3,087,491 | A | | 4/1963 | Gewecke et al. | |
| 3,119,548 | A | | 1/1964 | Cook et al. | |
| 3,143,277 | A | | 8/1964 | LaFleur | |
| 3,208,658 | A | | 9/1965 | Membrino | |
| 3,224,640 | A | | 12/1965 | Schneider | |
| 3,244,576 | A | | 4/1966 | Swath | |
| 3,253,764 | A | | 5/1966 | Goetschius | |
| 3,275,197 | A | | 9/1966 | Eklund | |
| 3,289,386 | A | * | 12/1966 | Farmer | 53/415 |
| 3,319,684 | A | | 5/1967 | Calhoun | |
| 3,349,991 | A | | 10/1967 | Kessler | |
| 3,367,380 | A | | 2/1968 | Dickey | |
| 3,370,774 | A | | 2/1968 | Hopf | |
| 3,384,106 | A | | 5/1968 | Isbrandtsen | |
| 3,386,645 | A | * | 6/1968 | Powell | 383/106 |
| 3,415,440 | A | * | 12/1968 | Waiters | 383/108 |
| 3,447,732 | A | | 6/1969 | Jonas | |
| 3,462,067 | A | | 8/1969 | Shore | |
| 3,510,142 | A | | 5/1970 | Erke | |
| 3,550,662 | A | | 12/1970 | Remke et al. | |
| 3,559,847 | A | | 2/1971 | Goodrich | |
| 3,709,426 | A | | 1/1973 | Farkas | |
| 3,739,977 | A | | 6/1973 | Shapiro et al. | |
| 3,761,013 | A | * | 9/1973 | Schuster | 206/439 |
| 3,836,217 | A | | 9/1974 | Shiina | |
| 3,853,238 | A | | 12/1974 | Luisada et al. | |
| 3,868,891 | A | * | 3/1975 | Parish | 493/194 |
| 3,951,284 | A | | 4/1976 | Fell et al. | |
| 3,965,953 | A | | 6/1976 | Becker et al. | |
| 3,989,157 | A | | 11/1976 | Veenema | |
| 3,995,806 | A | | 12/1976 | McSherry | |
| 4,011,798 | A | | 3/1977 | Bambara et al. | |
| 4,025,048 | A | | 5/1977 | Tibbitts | |
| 4,085,244 | A | * | 4/1978 | Stillman | 383/116 |
| 4,169,548 | A | | 10/1979 | Bond | |
| 4,174,051 | A | | 11/1979 | Edwards | |
| 4,177,907 | A | | 12/1979 | Funaioli et al. | |
| 4,184,527 | A | | 1/1980 | Kawamura | |
| 4,239,111 | A | * | 12/1980 | Conant et al. | 206/484 |
| 4,267,960 | A | * | 5/1981 | Lind et al. | 383/106 |
| 4,270,533 | A | | 6/1981 | Andreas | |
| 4,309,466 | A | | 1/1982 | Stillman | |
| 4,362,199 | A | | 12/1982 | Futerman | |
| 4,421,253 | A | | 12/1983 | Croley | |
| 4,449,646 | A | | 5/1984 | Bonerb et al. | |
| 4,457,456 | A | | 7/1984 | Derby et al. | |
| 4,461,402 | A | | 7/1984 | Fell et al. | |
| 4,476,998 | A | | 10/1984 | Bonerb et al. | |
| 4,482,074 | A | | 11/1984 | Lalley | |
| 4,524,459 | A | | 6/1985 | Titchenal | |
| 4,548,321 | A | | 10/1985 | Mockesch et al. | |
| 4,560,090 | A | | 12/1985 | Okushita | |
| 4,561,107 | A | | 12/1985 | Herder | |
| 4,596,040 | A | | 6/1986 | LaFleur et al. | |
| 4,597,102 | A | | 6/1986 | Nattrass | |
| RE32,232 | E | | 8/1986 | Bonerb et al. | |
| 4,636,190 | A | | 1/1987 | Herder | |
| 4,673,112 | A | | 6/1987 | Bonerb | |
| 4,674,127 | A | | 6/1987 | Yamada et al. | |
| 4,676,373 | A | | 6/1987 | Schneider | |
| 4,715,508 | A | | 12/1987 | Schurch | |
| 4,718,577 | A | | 1/1988 | Morris et al. | |
| 4,730,942 | A | | 3/1988 | Fulcher | |
| 4,781,472 | A | | 11/1988 | LaFleur et al. | |
| 4,783,178 | A | | 11/1988 | Herder | |
| 4,790,029 | A | | 12/1988 | LaFleur et al. | |
| 4,796,788 | A | | 1/1989 | Bond | |
| 4,804,113 | A | | 2/1989 | Ciaccio | |
| 4,850,506 | A | | 7/1989 | Heaps et al. | |
| 4,874,258 | A | | 10/1989 | Marino | |
| 4,898,301 | A | * | 2/1990 | Schick | 229/117.27 |
| 4,917,255 | A | | 4/1990 | Foy | |
| 4,931,034 | A | | 6/1990 | Wagner | |
| 4,941,754 | A | | 7/1990 | Murdock | |
| 4,997,108 | A | | 3/1991 | Hata | |
| 4,998,990 | A | * | 3/1991 | Richter et al. | 222/92 |
| 5,002,194 | A | | 3/1991 | Nichols | |
| 5,020,922 | A | * | 6/1991 | Schirmer | 383/119 |
| 5,029,734 | A | | 7/1991 | Nichols | |
| 5,037,002 | A | * | 8/1991 | Tschanen | 222/105 |
| 5,040,693 | A | | 8/1991 | Podd et al. | |
| 5,054,644 | A | | 10/1991 | Greenslade | |
| 5,056,667 | A | | 10/1991 | Coogan | |
| 5,074,460 | A | | 12/1991 | Hanekamp | |
| 5,096,092 | A | | 3/1992 | Devine | |
| 5,104,236 | A | | 4/1992 | LaFleur | |
| 5,120,586 | A | | 6/1992 | Nedzu et al. | |
| 5,127,893 | A | | 7/1992 | Lafleur | |
| 5,156,291 | A | | 10/1992 | Mielke | |
| 5,193,710 | A | | 3/1993 | Podd et al. | |
| 5,195,661 | A | | 3/1993 | Light | |
| 5,253,763 | A | | 10/1993 | Kirkley et al. | |
| 5,269,414 | A | | 12/1993 | D'Hollander | |
| 5,302,402 | A | * | 4/1994 | Dudenhoeffer et al. | 426/129 |
| 5,314,086 | A | | 5/1994 | Short | |
| 5,314,250 | A | | 5/1994 | Lee | |
| 5,330,069 | A | | 7/1994 | Jamison et al. | |
| 5,335,820 | A | | 8/1994 | Christianson | |
| 5,338,117 | A | | 8/1994 | Kucksdorf et al. | |
| 5,344,048 | A | | 9/1994 | Bonerb | |
| 5,344,065 | A | | 9/1994 | Moran | |
| 5,350,239 | A | | 9/1994 | Strand et al. | |
| 5,368,395 | A | | 11/1994 | Crimmins | |
| 5,400,916 | A | | 3/1995 | Weber | |
| 5,427,306 | A | | 6/1995 | Petriekis et al. | |
| 5,487,470 | A | | 1/1996 | Pharo | |
| 5,489,037 | A | | 2/1996 | Stopper | |
| 5,492,270 | A | | 2/1996 | Avery et al. | |
| 5,494,394 | A | | 2/1996 | Podd et al. | |
| 5,499,743 | A | * | 3/1996 | Blumenkron | 222/107 |
| 5,531,361 | A | | 7/1996 | Podd | |
| 5,547,284 | A | | 8/1996 | Imer | |
| 5,549,944 | A | * | 8/1996 | Abate | 428/35.2 |
| 5,588,549 | A | | 12/1996 | Furtner | |
| 5,618,254 | A | | 4/1997 | Derby | |
| 5,636,764 | A | | 6/1997 | Bonerb | |
| 5,660,299 | A | | 8/1997 | Harvey | |
| 5,692,546 | A | | 12/1997 | Podd et al. | |
| 5,711,444 | A | | 1/1998 | Meacham et al. | |
| 5,765,723 | A | | 6/1998 | Wilcox | |
| 5,775,541 | A | | 7/1998 | Perkins | |
| 5,788,121 | A | | 8/1998 | Sasaki et al. | |
| 5,799,818 | A | | 9/1998 | Ringer | |
| 5,851,072 | A | | 12/1998 | LaFleur | |
| 5,865,541 | A | | 2/1999 | LaFleur | |
| 5,915,596 | A | * | 6/1999 | Credle, Jr. | 222/105 |
| 5,918,984 | A | | 7/1999 | LaFleur et al. | |
| 5,941,421 | A | * | 8/1999 | Overman et al. | 222/105 |
| 5,984,850 | A | | 11/1999 | Derby | |
| 5,988,422 | A | | 11/1999 | Vallot | |
| 6,120,181 | A | | 9/2000 | Wilcox | |
| 6,139,482 | A | | 10/2000 | LaFleur | |
| 6,193,416 | B1 | | 2/2001 | Kawamata et al. | |
| 6,234,351 | B1 | | 5/2001 | Wilcox | |
| 6,371,646 | B1 | | 4/2002 | LaFleur | |
| 6,378,733 | B1 | | 4/2002 | Boonzaier | |
| 6,427,873 | B2 | | 8/2002 | Wilcox | |
| 6,443,617 | B2 | | 9/2002 | Tetenborg | |
| 6,467,652 | B2 | | 10/2002 | Wilcox et al. | |
| 6,527,445 | B2 | | 3/2003 | LaFleur et al. | |
| 6,533,122 | B1 | | 3/2003 | Plunkett | |
| 6,536,687 | B1 | | 3/2003 | Navis et al. | |
| 6,588,681 | B2 | | 7/2003 | Rothrum et al. | |
| 6,595,441 | B2 | | 7/2003 | Petrie et al. | |
| 6,607,097 | B2 | * | 8/2003 | Savage et al. | 222/1 |
| 6,644,510 | B2 | | 11/2003 | Kawolics et al. | |
| 6,663,018 | B2 | | 12/2003 | Rothrum et al. | |
| 6,752,179 | B1 | | 6/2004 | Schwartz | |
| 6,883,683 | B1 | | 4/2005 | Cunningham et al. | |
| 7,077,309 | B2 | | 7/2006 | Andrews | |
| 7,244,064 | B2 | | 7/2007 | Sullivan, Jr. | |

| | | | | |
|---|---|---|---|---|
| 7,334,702 | B2 | 2/2008 | Cunningham et al. | |
| 2002/0071922 | A1 * | 6/2002 | Bailey | 428/35.3 |
| 2002/0148857 | A1 * | 10/2002 | Savage et al. | 222/107 |
| 2002/0164089 | A1 | 11/2002 | LaFleur et al. | |
| 2003/0235349 | A1 | 12/2003 | Ricahrdson, Jr. et al. | |
| 2005/0017011 | A1 | 1/2005 | Andrews | |
| 2005/0078890 | A1 | 4/2005 | Abe et al. | |
| 2005/0100252 | A1 | 5/2005 | Rivlin et al. | |
| 2005/0220369 | A1 | 10/2005 | Sullivan, Jr. | |
| 2005/0220639 | A1 | 10/2005 | Sasaki et al. | |
| 2006/0023973 | A1 | 2/2006 | Plunkett | |
| 2007/0076988 | A1 | 4/2007 | Sullivan et al. | |
| 2007/0201774 | A1 | 8/2007 | Plunkett et al. | |

FOREIGN PATENT DOCUMENTS

| | | | |
|---|---|---|---|
| CA | 2 156 796 | A1 | 2/1997 |
| DE | 60 598 | | 11/1890 |
| DE | 1 486 433 | | 4/1969 |
| DE | 68906059.8 | U1 * | 11/1989 |
| EP | 0 098 322 | A1 | 1/1984 |
| EP | 0 362 102 | A1 | 4/1990 |
| EP | 0 276 994 | | 12/1992 |
| EP | 1 277 666 | A1 | 1/2003 |
| EP | 1435265 | | 7/2004 |
| EP | 1415719 | | 5/2009 |
| FR | 1.331.060 | | 5/1963 |
| FR | 1 331 060 | | 6/1963 |
| FR | 2 316 151 | | 3/1977 |
| FR | 2 375 113 | | 8/1978 |
| FR | 2 742 129 | A1 | 6/1997 |
| GB | 1 591 323 | A | 6/1981 |
| GB | 2 194 512 | A | 3/1988 |
| GB | 2 245 883 | | 1/1992 |
| GB | 2 268 231 | | 1/1994 |
| GB | 2 323 846 | A | 10/1998 |
| JP | 64-009174 | | 1/1989 |
| JP | 2-139383 | | 5/1990 |
| JP | 5-221451 | | 8/1993 |
| JP | 6-115557 | | 4/1994 |
| JP | 6-122457 | | 5/1994 |
| JP | 6-179455 | | 6/1994 |
| JP | 6-255657 | | 9/1994 |
| JP | 8-104391 | | 4/1996 |
| WO | 82/03838 | | 11/1982 |
| WO | 89/11422 | | 11/1989 |
| WO | 98/32539 | | 7/1998 |
| WO | 02/057151 | | 7/2002 |
| WO | 02/064456 | | 8/2002 |
| WO | 02/074226 | A2 | 9/2002 |
| WO | 2007/038438 | | 4/2007 |

OTHER PUBLICATIONS

Advertisement, "Designed with Food in Mind," "The Unifold Food Grade Intermediate Bulk Container," LB Systemer a/s Uni-Fold, Nordgarde 1A-4520 Svinninge Denmark, 5 pgs.

Advertisement, "Stocklin, Collapsible Container," "Innovative and Environment-Friendly Packaging," Walter Stocklin AG, Forder Und Lagertechnik, CH-4143 Dornach/Schweiz, 4 pgs.

Advertisement, "CFS Developments (Proprietary) Ltd.," Postal Address: P.O. Box 4852 Luipaardsvlei 1743 South Africa, 4 pgs.

Advertisement, Reusable Container Systems, "Industry Leader in quality, innovation and service," Ropak Corporation, Materials Handling Group, A Member of the Linpac Group of Companies, 7 pgs.

Advertisement, "ECONOBOX, A Whole New Dimension," "Cost-effective Solutions for Materials Handling," GE Polymer Logistics, 3 pgs.

Advertisement, "Introducing the Arena 330 Shipper," "It beats the drum and everything else," GE Silicones, A. R. Arena Products, Inc., 2101 Mt. Read Blvd., Rochester, New York 1465, 4 pgs.

Advertisement, "TNT Container Logistics," :"Containers for Hazardous Goods," "Hazcon & Uni-Fold," 2 pgs.

* cited by examiner

FLEXIBLE LINER FOR FIBC OR BAG-IN-BOX CONTAINER SYSTEMS WITH IMPROVED FLEX CRACK RESISTANCE

FIELD OF THE INVENTION

The present invention relates to flexible liners for use in bulk containers such as those used in flexible intermediate bulk container ("FIBC") systems or bag-in-box container systems. More particularly, the present invention relates to systems and methods for reducing flex crack failure and the need for dunnage in a FIBC or bag-in-box container system.

BACKGROUND OF THE INVENTION

In recent years a number of industries have adopted the FIBC or bag-in-box concept for storing and transporting liquid and particulate commodities in relatively large quantities. For example, the FIBC or bag-in-box concept has been employed for transporting in bulk such diverse products as vegetable oils, salad dressings, syrups, soy sauce, peanut butter, pharmaceuticals, talc, motor oil, industrial chemicals, detergents in liquid or powder form, and toiletry products or ingredients.

The FIBC concept is a bulk container system comprising a flexible liner in a flexible or semi-flexible bag. In one embodiment, a FIBC bag is made of a woven material (e.g., woven polymer, TYVEX®, canvas, wire mesh or net). The flexible liner is typically chemically resistant and impermeable to water and air and serves as the container for a selected commodity. The FIBC bag serves as a protective container for the liner and its contents. A FIBC bag is disclosed in U.S. Pat. No. 4,596,040 to LaFleur et al., which issued Jun. 17, 1986, and is hereby incorporated by reference in its entirety.

The bag-in-box concept comprises a flexible liner and a rigid or semi-rigid box. The flexible liner is typically chemically resistant and impermeable to water and air and serves as the container for a selected commodity. The box may be made of plywood or other wood materials, cardboard, fiberboard, metal, or plastic. The box serves as a protective container for the liner and its contents. A box for a bag-in-box system is disclosed in U.S. Pat. No. 6,533,122 to Plunkett, which issued Mar. 18, 2003, and is hereby incorporated by reference in its entirety. A bag for use in a bag-in-box system is disclosed in U.S. patent application Ser. No. 10/818,882, which was filed Apr. 6, 2004, is entitled "Bag With Flap For Bag-In-Box Container Systems" and is hereby incorporated by reference in its entirety.

By way of example, a liner used for shipping commodities in bulk, via a FIBC or bag-in-box system, typically may have a volume on the order of 300 gallons. In one embodiment, the liner will include at least a drain fitting near the bottom of the liner whereby the liner's contents may be removed. In other embodiments, the liner will include at least a filler fitting near the top of the liner whereby the liner may be filled with its contents. In other embodiments, the liner will include both a filler fitting near the top of the liner and a drain fitting near the bottom of the liner. In one embodiment, the drain fitting is on the gusseted side as described with respect to U.S. Patent Application No. 60/720,855, which was filed Sep. 26, 2005, entitled "Flexible Liner With Fitting On Gusseted Side."

The liner may be of any suitable configuration. For example, the liner may be generally shaped like a cube, or a pillow, a parallelepiped, or any other suitable configuration. It also can be configured so that a cross-section that is generally parallel to the top and bottom of the liner is square, rectangular, circular, or any other suitable geometry.

In embodiments of the liner with at least a drain fitting, the outer container (i.e., the bag of a FIBC system or the box of a bag-in-box system) is provided with a discharge opening at or towards the bottom end of the outer container through which the liquid or particulate contents can be discharged from the liner via its drain fitting. The discharge opening of the outer container may be fitted with a drain fitting that mates with or accommodates the drain fitting of the liner. This mating arrangement between drain fittings of the liner and outer container assures that material discharged from the liner will be directed to the intended receiving facility and prevents the material from accumulating in the bottom of the outer container.

In embodiments of the liner with at least a filler fitting, the outer container usually comprises a cover or top panel that is removable to permit access to the liner and the filler fitting.

One consideration of the FIBC or bag-in-box mode of shipment of materials in bulk is that the outer container can be a non-returnable or one-way container. For example, where the outer container is a box for a bag-in-box system and is generally made of a corrugated fiberboard or the like, the box can be discarded after use. Alternatively, the box may consist of interlocking panels of metal, wood, or a stiff or rigid plastic material, in which case the box may be disassembled and returned to the shipper after the associated liner has been emptied of its contents.

Where the outer container is a bag for a FIBC system and is made of a low cost woven material, the bag can be discarded after use. Alternatively, where the material of the bag is more expensive, the bag may be collapsed and returned to the shipper after the associated liner has been emptied of its contents.

With respect to the FIBC and bag-in-box concepts as applied to bulk shipment of commodities, the plastic flexible liners have taken various forms. One common form is the so-called "pillow" type, which consists of at least two sheets of plastic film sealed together at their edges. Another common form is the six-sided flexible liners (e.g., liners that take the shape of a cube or rectangular parallelepiped when filled) made from a plurality of sheets of plastic film. An example of this is described with respect to U.S. patent application Ser. No. 10/900,068, which was filed Jul. 27, 2004, entitled "Flexible Liner For FIBC Or Bag-In-Box Container Systems," hereby incorporated by reference in its entirety.

Regardless of the form the liner takes, the top half of the liner is generally more susceptible to flex crack failure than the bottom half from the film moving back and forth, typically resulting from greater product movement toward the top of the product than toward the bottom. This can lead to a breakdown of the liner's structural and/or barrier properties, possibly resulting in product degradation, loss of shelf life, contamination, damage to the contents, and/or loss of materials. In the past, particularly with pillow-shaped liners, this flex cracking has been reduced by packing the top part of the bag or box, above the liner, with a dunnage material to immobilize the upper portion of the liner. Having to add dunnage materials increases the cost and time required to ship goods and materials and does not always work, as some materials tend to settle over time, and liners are not necessarily always filled to the same height or extent.

There is a need in the art for a system and method of reducing flex crack failure in the liner of a FIBC or bag-in-box system, thereby preventing breakdown of the liner's structural and/or barrier properties and the harms associated with such breakdowns.

BRIEF SUMMARY OF THE INVENTION

In one embodiment, a liner for use in a bulk container is provided. The liner comprises a first flexible portion, a second flexible portion, a first seal joining the first and second portions, a second seal joining the first and second portions, a third seal joining the first and second portions, and a fourth seal joining the first and second portions. At least one of the first portion and second portion comprises at least one strip.

In one embodiment, a liner for use in a bulk container is provided. The liner comprises a first flexible portion, a second flexible portion, a first seal joining the first and second portions, a second seal joining the first and second portions, a third seal joining the first and second portions, and a fourth seal joining the first and second portions. The first portion is a better barrier than the second portion.

In one embodiment, a liner for use in a bulk container is provided. The liner comprises a first flexible portion, a second flexible portion, a first seal joining the first and second portions, a second seal joining the first and second portions, a third seal joining the first and second portions, and a fourth seal joining the first and second portions. The first portion and second portion comprises at least one ply and wherein the first portion comprises at least one more ply than the second portion.

In one embodiment, a method of flex crack protection in a flexible liner is provided. The liner comprises a first flexible portion and a second flexible portion, wherein the first portion and second portion each comprise at least one ply of flexible material. The method comprises manufacturing the first and second portion so that the first portion comprises at least one more ply than the second portion. The method also comprises sealing the plies of the first portion to the plies of the second portion.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION

Figure 1:
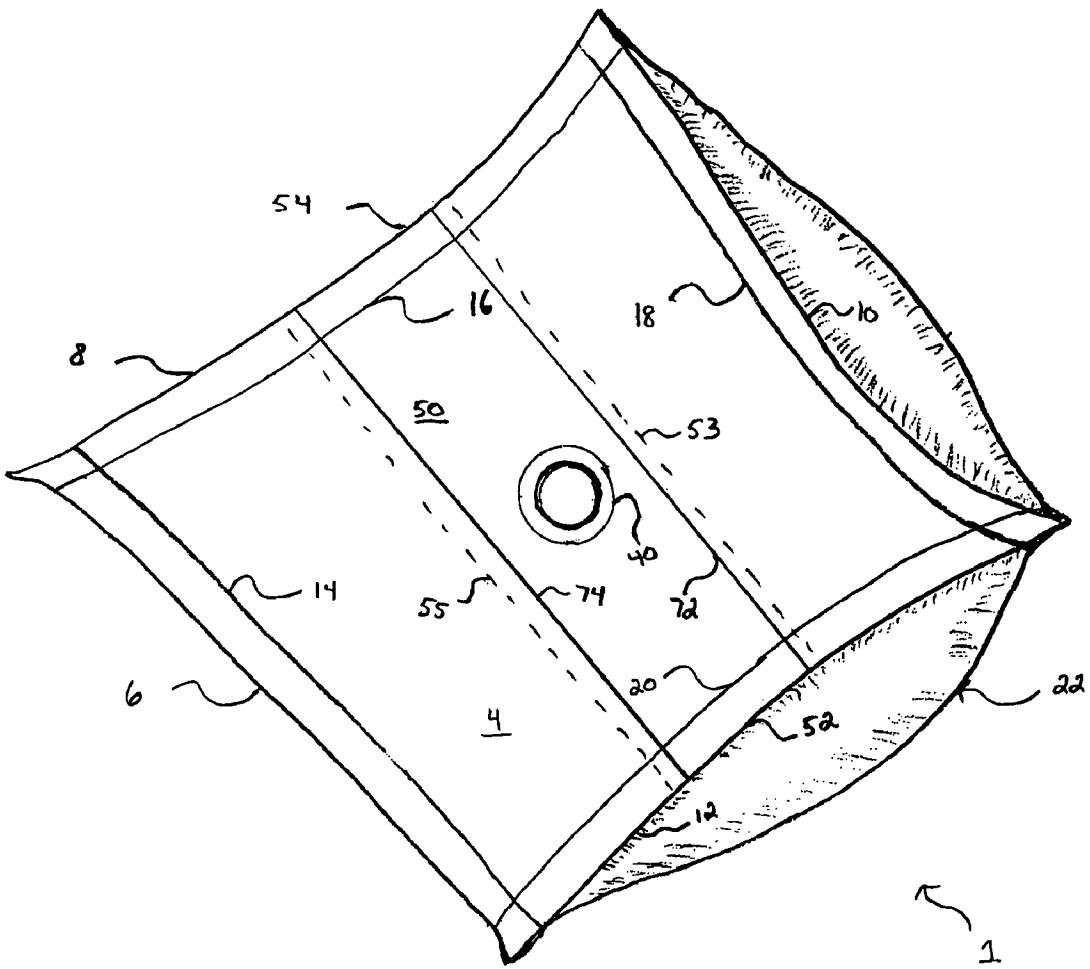
FIG. 1 is a top isometric view of a liner in its inflated or filled state.

The present invention is directed to a flexible liner 1 for use in bulk containers such as those used in flexible intermediate bulk container ("FIBC") systems or bag-in-box container systems. While certain liner embodiments are discussed herein, the particular liner configuration is generally not important to the present invention, and instead, any suitable liner configuration may be used. As will be discussed more fully below, the liner comprises a top portion and a bottom portion. The top portion and bottom portion are sealed together to form a pillow shaped liner. More specifically, longitudinal edges and lateral edges of the top portion and the bottom portion are sealed together.

In one embodiment, the top portion is composed of additional plies as compared to the bottom portion. This helps to reduce the susceptibility of the top portion to flex crack failure. This is because each ply has its own flex crack failure rate, and as the number of plies is increased, the odds of all the plies failing together decreases, and the odds of all plies failing in the same location decreases substantially. For illustrative purposes only, assume in a liner where each ply has a four percent chance of failing, and where a total of four plies are used. In this example, using probability (and assuming that each ply is statistically independent of the other plies), the odds of all four failing would be $(0.04)\times(0.04)\times(0.04)\times(0.04)$, or a total of 0.00000256, or 0.000256 percent. Increasing the thickness of the plies, however, typical increases the likelihood that there will be flex cracking as thicker materials are generally damaged more when bent. Therefore two plies of material are less likely to flex crack than one ply that is twice as thick.

Otherwise stated, a liner that has 3 layers, each of 4 mils, is 12 mils thick, and, likewise, a liner that has 6 layers, each 2 mils, also is 12 mils thick. Because each liner is 12 mils thick, they may have generally the same oxygen barrier properties. However, the liner that has 6 layers of 2 mils each would be more resistant to flex cracks that the liner that has 3 layers, each of 4 mils.

In one embodiment, at least one ply is comprised of double wound film. In another embodiment at least one ply is coextruded. One example of a coextruded ply is nylon coextruded with polyethylene. In another embodiment, at least one ply is laminated. In another embodiment, at least one ply is a single ply, for example a single ply of polyethylene. In another embodiment, at least one ply is comprised of a metallized polyester lamination. Any suitable material may be used.

In another embodiment, a strip is incorporated in the top portion to reduce the susceptibility to flex crack. In another embodiment, a strip is incorporated in the bottom portion. In another embodiment, a strip is incorporated in the top and bottom portions. In yet another embodiment, either the top portion, bottom portion, or both incorporate multiple strips. For simplicity, the following detailed description will refer to the strip as a single strip, though multiple strips can be used as well. The strip functions as another ply in its ability to increase flex crack resistance. However, since the strip is smaller in area compared to the plies that make up the top and bottom portions it can be made of more expensive materials without adding significant extra cost to the manufacturing process. For example, the strip can be composed of polyethylene, nylon, polyurethane, Valeron® or Valeron®-type materials, or any other suitable material, including but not limited to a monolayer, coextruded, or laminate material, that allows for the reduction of flex cracking or is used as a protective barrier. The strip functions especially well when placed in areas that are more susceptible to flex cracking, as it can increase the flex cracking resistance in those areas.

Both the plies on the top and bottom portion as well as the strip provide a barrier that protects the contents of the liner. Types of things the barrier attempts to block from entering the liner or exiting the liner are oxygen, odor, moisture, light, rodents, and other materials and substances that are desirably prevented from crossing the liner barrier. If a particular liner is susceptible to oxygen entering into the liner in a specific location, a strip can be added to that specific location, wherein the strip is made of a material that is suited to enhance the barrier characteristics of the liner for oxygen or any other specific material or substance.

FIG. 1 is a top isometric view of the liner 1 in its inflated or filled state. As indicated in FIG. 1, in one embodiment, the liner 1 is a two side-seal type liner 1 of flexible, heat-sealable packaging material in sheet form. In another embodiment, liner 1 is a six-sided flexible liner as described with respect to U.S. patent application Ser. No. 10/900,068, which was filed Jul. 27, 2004, entitled "Flexible Liner For FIBC Or Bag-In-Box Container Systems," incorporated above.

The materials used to make the liners of the present invention may be of any suitable material. In one embodiment, the material may consist of polyethylene or polypropylene or some other thermoplastic material or be a laminate of two or more packaging materials bonded to one another. In another embodiment, the packaging sheet material may consist of double wound film. In another embodiment, the packaging sheet material may consist of nylon coextruded or laminated to at least one other packaging material.

Liner 1 comprises a top portion 4 and bottom portion 22. Each of the portions 4 and 22 may comprise a single sheet of packaging material ("single ply") or two or more sheets of packaging material ("multi-ply"). In the case of multi-ply portions, the individual sheets ("plies") may be of like or different material and are secured to one another only in selected areas (e.g., at seals 14, 16, 18, 20).

Figure 4:
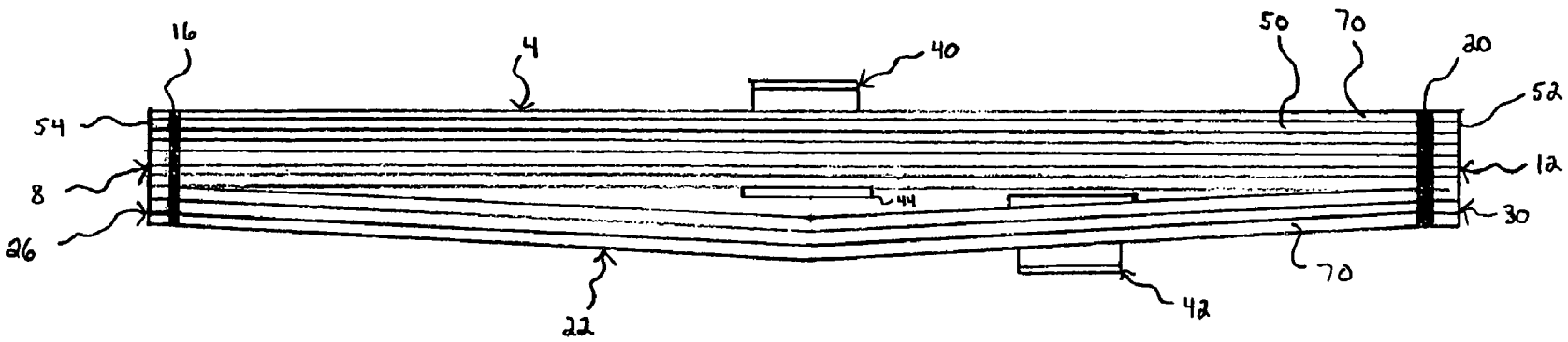
FIG. 4 is a cross sectional view taken along line 4-4 of FIG. 2.
Figure 5:
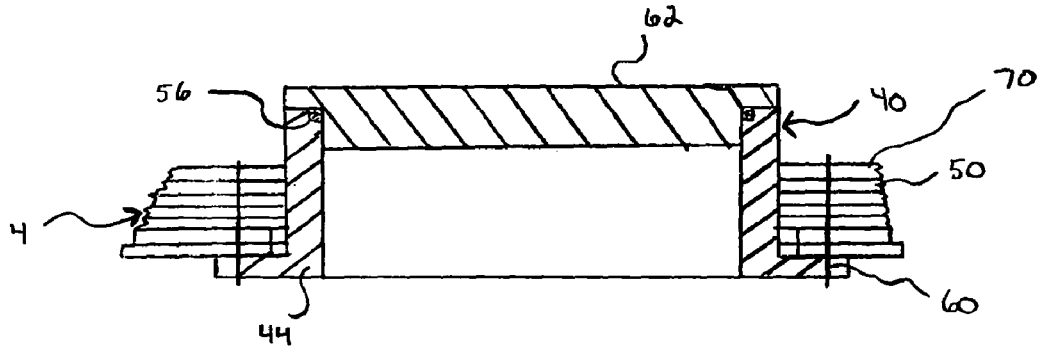
FIG. 5 is a cross sectional view of a fill fitment taken along line 5-5 of FIG. 2.

For convenience and simplicity of illustration, a construction involving seven plies on the top portion 4 and three plies on the bottom portion 22 is shown in FIGS. 4 and 5. However, in the following description, it is to be assumed and understood that each of the top portion 4 and bottom portion 22 can consist of varying amounts of plies.

Figure 2:
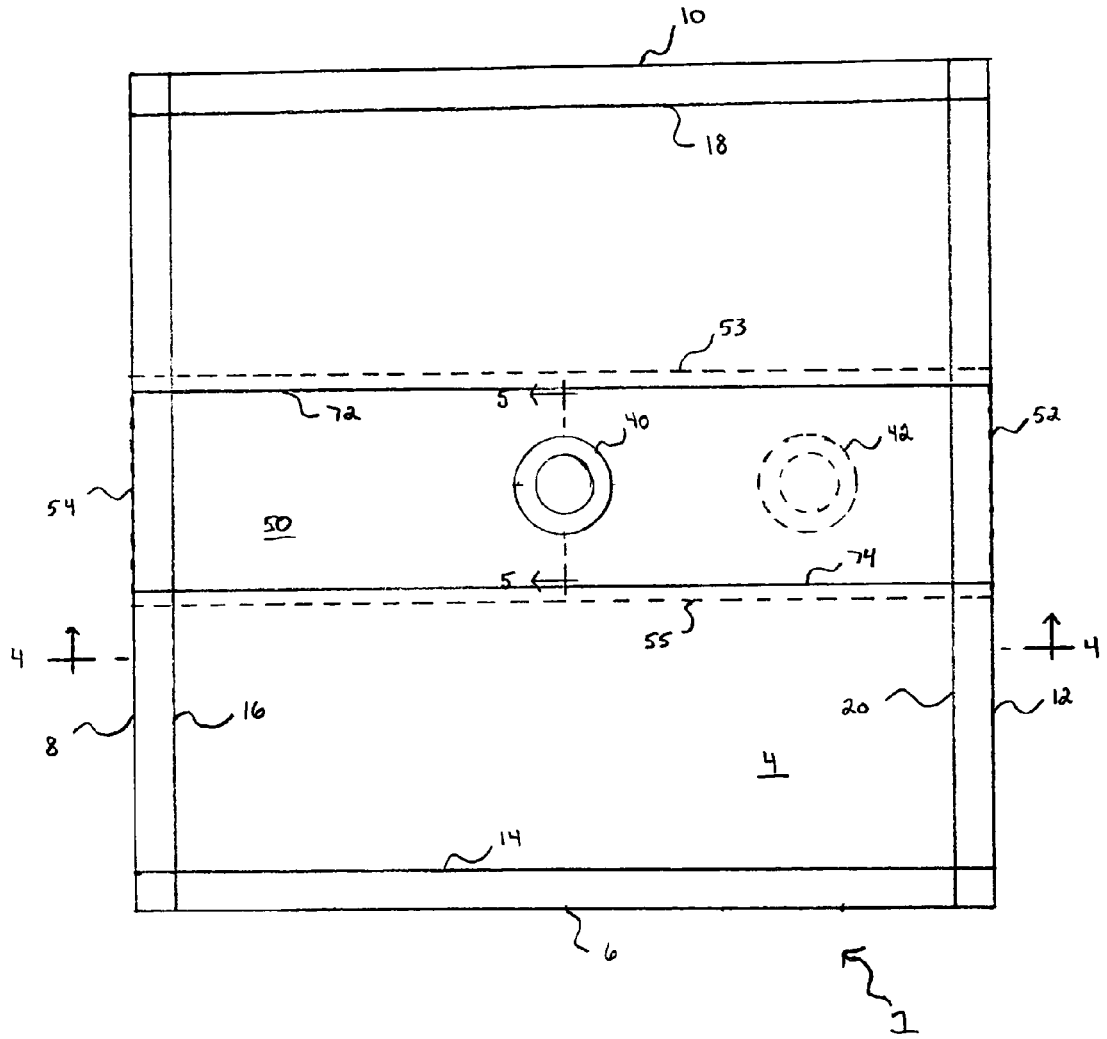
FIG. 2 is a top view of the liner in a flattened as-made condition.
Figure 3:
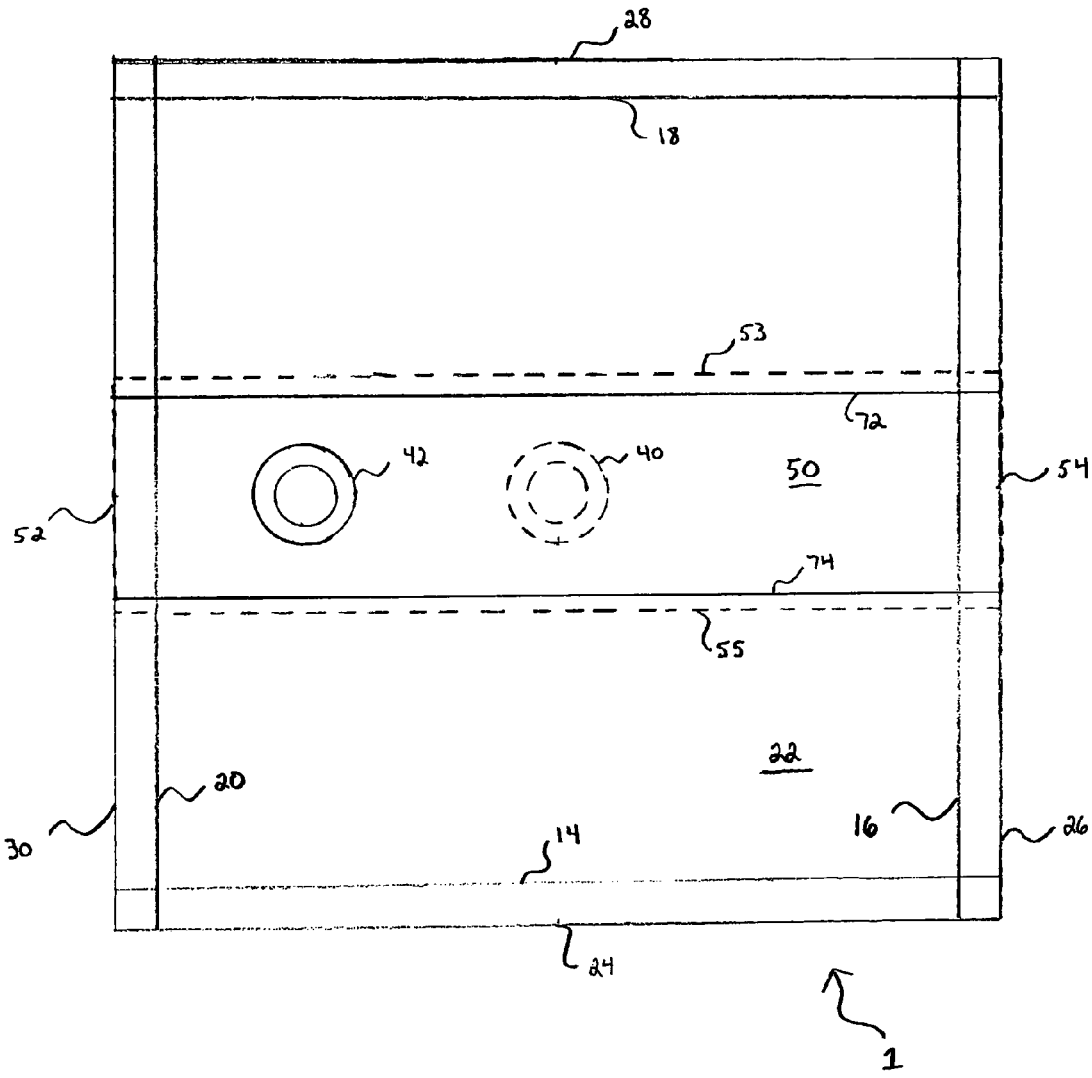
FIG. 3 is a bottom view of the same liner in its flattened as-made condition.

For a discussion of the liner 1 in its flat as-formed condition, reference is now made to FIGS. 2-4. FIG. 2 is a top plan view of the liner 1 in its flattened as-made condition. FIG. 3 is a bottom view of the liner 1 in its flattened as-made condition. FIG. 4 is a cross sectional view of the liner 1 taken along line 4-4 of FIG. 2. As shown in FIGS. 2-4, the top portion 4 and the bottom portion 22 are opposed to one another.

The liners of the present invention may be of any suitable configuration, including generally square, generally rectangular, generally triangular, generally circular, or any other desired configuration. As shown in FIGS. 2 and 3, when the liner 1 is in the flattened as-made condition, the top portion 4 and the bottom portion 22 may have a generally square configuration. Top portion 4 shown in FIGS. 2 and 3 is defined by a lateral edge 10, a lateral edge 6, and two longitudinal edges 8, 12. The lateral edges 10, 6 are generally perpendicular to the longitudinal edges 8, 12. Bottom portion 22 is defined by a lateral edge 28, a lateral edge 24 and two longitudinal edges 26, 30. The lateral edges 28, 24 are generally perpendicular to the longitudinal edges 26, 30. During manufacture, the two portions 4 and 22 may be cut from parallel elongate supply webs of packaging material. The two portions 4 and 22 may be substantially the same width (i.e., the distance between the longitudinal edges 8, 12 and the distance between longitudinal edges 26, 30) and substantially the same length (i.e., the distance between lateral edges 10, 6 and the distance between lateral edges 28, 24).

The materials used to make the present invention may be provided in any suitable form, including as one or more single continuous sheet, as a multi-ply or laminate, as a tubular film, which may be equivalent to two or more sheets that are brought together to form a multiply portion of a liner, or in any other suitable form.

In one embodiment of the present invention, the liner may be made with more layers than prior art liners. This may be done in any suitable manner. In one embodiment, the liner may be made with one or more layers of material being replaced by twice as many layers of material, with each of the two replacement layers being one-half the thickness of the single layer they replace. Doing so results in a liner that weighs and costs the same as the prior art liner, but has improved flex crack resistance. From a manufacturing standpoint, this result may be achieved in any suitable manner, including by replacing one or more layers with a double-wound material that is generally half the thickness of the layer being replaced.

Furthermore, as described below, the allocation of layers to the top portion 4 of the liner 1 and the bottom portion 22 of the liner 1 may be done in any manner desired. For example, where the liner of the present invention has ten layers, five of those ten layers may be used as the top portion 4 of the liner 1, and the other five layers as the bottom portion 22 of the liner 1. This can be done by the use of seals, and by grouping the layers as desired when placing the fitments on the liner 1. In alternative embodiments of a liner 1 with ten layers, the top portion 4 of the liner 1 may have from one to nine layers, and the bottom portion 22 of the liner 1 may have from nine to one layers. In one embodiment, as discussed below, the top portion 4 of the liner 1 may have seven layers, and the other three layers of the liner 1 form the bottom portion 22 of the liner 1. Not only can the allocation of layers to the top portion 4 of the liner 1 and the bottom portion 22 of the liner 1 vary as desired, but the total number of layers used to make the liner 1 also can be any suitable number.

As shown in FIGS. 2, 3, and 4, the top portion 4 is sealed to the bottom portion 22. This is accomplished by two longitudinal seals 16 and 20 and two lateral seals 14 and 18. Lateral seal 14 is located near the lateral edges 6, 24 of respective top portion 4 and bottom portion 22. Longitudinal seal 16 is located near the longitudinal edges 8, 26 of respective top portion 4 and bottom portion 22. Lateral seal 18 is located near the lateral edges 10, 28 of respective top portion 4 and bottom portion 22. Longitudinal seal 20 is located near the longitudinal edges 12, 30 of respective top portion 4 and bottom portion 22.

As shown in FIGS. 1, 2, and 3, seals 14, 16, 18, and 20 extend through each other (except for seals that are parallel to one another). In other embodiments, the seals 14, 16, 18, and 20 stop at their respective intersections. In one embodiment, the liner 1 comprises a strip 50 that is used as an additional barrier layer for liner 1. In one embodiment, the strip 50 increases the flex crack resistance of the liner 1. In one embodiment, multiple strips 50 are used in liner 1. As shown in FIGS. 1, 2, and 3, the strip 50 has longitudinal edges 52, 54 and lateral edges 53, 55. In one embodiment, strip 50 is incorporated in the top portion 4 of liner 1. In another embodiment, the strip 50 is incorporated in the bottom portion 22 of liner 1. In the embodiments shown, the strip 50 is substantially rectangular though it may be shapes other than rectangular.

In this embodiment, strip 50 is substantially centrally located between seals 18 and 14. In one embodiment longitudinal edges 52, 54 of strip 50 are sealed by seals 20 and 16 respectively. In another embodiment, lateral edges 53, 55 of strip 50 are sealed by a lateral seal 72 and a lateral seal 74. Strip 50 can be sealed either by seals 20 and 16 or by seals 72 and 74, both, or any suitable combination of these. In another embodiment, strip 50 could be rotated 90 degrees so that it is substantially centrally located between seals 20 and 16 and edges 52, 54 are sealed by seals 18 and 14 and edges 53, 55 are sealed by seals 16 and 20. In this embodiment, strip 50 is not the full length of other plies that make up top portion 4 and bottom portion 22, though in other embodiments it is substantially the same length and width as other plies. In one embodiment, the width of strip 50 is approximately 50.0" and the width of other plies is approximately 85.0" (both the strip and the other plies having a length of approximately 81.0"). The plies can be of any width and length. In other embodiments, the strip 50 has a width that is generally between 45.0 and 60.0 inches. The strip 50, however, can be any width and length, and is generally used as a protective barrier for liner 1.

FIG. 4 illustrates one embodiment comprising seven plies on the top portion 4 and three plies on the bottom portion 22. In one embodiment, the top ply of top portion 4 is a metallized polyester laminate ply 70. The metallized polyester laminate ply 70 is generally used for its barrier properties, and may provide such benefits as oxygen barrier, sunlight reflection, improved shelf life of the materials in the liner 1, and others. In other embodiments, ply 70 is the bottom ply of bottom portion 22. In further embodiments, there are no metallized polyester laminate plies. In yet another embodiment, both bottom portion 22 and top portion 4 include a metallized ply 70 as their respective outer plies.

All plies in liner 1 contain some barrier characteristics, and as additional plies are added the barrier is generally increased so that undesirable elements, such as oxygen, odor, rodents, moisture, punctures, and others, are substantially prevented from passing through the barrier, and desired elements are kept within the liner. The more effective a barrier is at preventing materials and substances from moving from one side to the other, the better that barrier is said to be. Thus, where a first barrier is more effective at preventing materials and substances from passing through it than is a second barrier, the first barrier is said to be better than the second barrier.

In this embodiment, strip 50 is located between the first and third plies of top portion 4, though strip 50 can be located throughout top portion 4 and bottom portion 22, in order to reduce flex cracking. Where one strip 50 is used, the strip 50 may be placed at any suitable location, including as the outermost layer, the innermost layer, or anywhere in between. Where more than one strip 50 is used, the strips 50 may be placed at any combination of the above locations. Additional strips 50 can be included throughout top portion 4 and bottom portion 22. The layers of the liner can be of any suitable material, as known to those skilled in the art. Each layer also can be of any suitable or desired thickness. For example, Metallized Polyester Laminate layers, hereinafter referred to as MPET layers, generally can range from 1 to 8 mils thick, or from 4 to 4.5 mils thick. Likewise, polyethylene layers generally can range from 1 to 8 mils thick, or from 2.75 to 4 mils thick. In one liner embodiment, the top portion 4 comprises a top ply comprised of MPET, and six internal plies of 2.0 mil polyethylene. The bottom portion 22 comprises one internal ply of 2.0 mil polyethylene and external (bottom) ply of MPET. In one embodiment, the polyethylene described above and below in the top and bottom portions 4, 22 is a metalocene linear low-density polyethylene.

In another embodiment, the top portion 4 has a top ply comprised of MPET and four interior plies, each 2.0 mil polyethylene. The bottom portion 22 comprises four interior plies each 2.0 mil polyethylene, and a external ply of MPET.

In yet another embodiment, the top portion 4 has a top ply comprised of MPET, a strip 50 comprised of 4.0 mil Coex Nylon/ethylene vinyl alcohol, and four plies comprised of 2.0 mil polyethylene each. The bottom portion 22 is comprised of four interior plies made of 2.0 mil polyethylene each and a external ply comprised of MPET.

In another embodiment, the top portion 4 has a top ply comprised of MPET, and two interior plies, each 4.0 mil polyethylene. The bottom portion is comprised of two interior plies each 4.0 mil polyethylene and an external ply comprised of MPET.

For a discussion of the location of the fill and drain orifices of the liner 1, reference is now made to FIGS. 2 and 3. As shown in FIGS. 2 and 3, the top portion 4 is formed with one opening, and the bottom portion 22 is formed with a second opening. Mounted in those openings are two tubular fitments, a drain fitment 42 and fill fitment 40. The drain fitment 42 is intended to function as a drain and, for illustrative purposes only, may be located generally equidistant from the top and bottom edges 28, 24, and closer to side edge 30 than side edge 26. The fill fitment 40 is for filling purposes and, for illustrative purposes only, located substantially at the center of top portion 4. In one embodiment, the liner 1 will only have a drain fitment 42. In another embodiment, the liner 1 will only have a fill fitment 40. As is shown in FIGS. 4 and 5 the top portion 4 and bottom portion 22 are defined by the placement of a fill and a drain fitment 40, 42. As the liner 1 is filled, separation occurs between the top portion 4 and bottom portion 22 in the non-sealed areas.

For a discussion of one method of securing the fill fitment 40 to the top portion 4, reference is now made to FIG. 5, which is a cross sectional view of one type of fill fitment 40 taken along line 5-5 of FIG. 2. As indicated in FIG. 5, in one embodiment, the fill fitment 40 may comprise two parts, a fixed tubular part 56 and a cap 62. The fixed tubular part 56 has a flange 44 that underlies and is sealed to the top portion 4 by a circular seal 60. The cap 62 is releasably attached to and closes off the tubular part 56. The cap 60 may be attached to the tubular part 56 by a screw, bayonet, snap-fit, or other suitable form of connection known in the art. In one embodiment, drain fitment 42 is secured in a substantially similar way to bottom portion 22 as fill fitment 40 is secured to top portion 4. Any suitable fitment may be used. One-piece fittings also may be used. The fitment may be aseptic, if desired.

In one embodiment, the fitments 40, 42 may have different structures or shapes. In one embodiment, the filler fitment 40 may be omitted, in which case the drain fitment 42 may also serve as a filler means for the liner by attaching a pump discharge line to insert the contents into the liner 1. Conversely, the drain fitment 42 may be omitted, in which case the filler fitment 40 may also serve as a drain means for the liner by running a pump suction line down into the liner to remove the contents of the liner 1.

Although the seals whereby the two portions 4 and 22 are connected together are illustrated by single lines, it is to be understood that the seals that connect the top and bottom portions 4, 22 may vary in width and, for example, may extend out to the edges of the two portions 4, 22.

Although the invention has been described with reference to embodiments, persons skilled in the art will recognize that changes may be made in form and detail without departing from the spirit and scope of the invention. All directional references (e.g., top, bottom, sides, internal, external) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. It is intended that all matter contained in the above description or shown in the accompanying drawings shall be interpreted as illustrative only and not limiting. Changes in detail or structure may be made without departing from the spirit of the invention as defined in the appended claims.

We claim:

1. A liner for use in a bulk container, the liner comprising:

a first flexible portion including a first longitudinal edge, a second longitudinal edge, a first lateral edge generally perpendicular to the first and second longitudinal edges, and a second lateral edge generally perpendicular to the first longitudinal and second longitudinal edges and generally parallel to the first lateral edge, the first portion comprising at least two plies;

a second flexible portion including a third longitudinal edge, a fourth longitudinal edge, a third lateral edge generally perpendicular to the third and fourth longitudinal edges, and a fourth lateral edge generally perpendicular to the third longitudinal and fourth longitudinal edges and generally parallel to the third lateral edge, wherein the first and second flexible portions are substantially the same size and shape;

a first seal joining the first and second portions near the first and third longitudinal edges and running generally parallel to the first and third longitudinal edges;

a second seal joining the first and second portions near the second and fourth longitudinal edges and running generally parallel to the second and fourth longitudinal edges;

a third seal joining the first and second portions near the first and third lateral edges and running generally parallel to the first and third lateral edges;

a fourth seal joining the first and second portions near the second and fourth lateral edges and running generally parallel to the second and fourth lateral edges;

wherein the first portion comprises at least one strip located between plies of the first portion, the at least one strip being sized and shaped smaller than the first portion, wherein the at least one strip includes a first and a second longitudinal edge and a first and second lateral edge, and wherein the first longitudinal edge of the at least one strip is sealed by at least one of the first or third seals and the second longitudinal edge of the at least one strip is sealed by at least one of the second or fourth seals; and a fitment positioned on the first portion and through the at least one strip, wherein the liner is fillable between the first and second portions through the fitment after said first and second portions have been sealed at the first, second, third, and fourth seals.

2. The liner of claim 1, wherein the at least one strip is generally parallel to and located substantially equidistant between the third and fourth seals.

3. The liner of claim 1, wherein the first and second longitudinal strip edges are shorter than the first, second, third and fourth longitudinal edges.

4. The liner of claim 1, wherein the first portion and second portions comprise at least one ply and the first portion comprises at least one more ply than the second portion.

5. The liner of claim 1, wherein the first portion comprises at least one more strip than the second portion.

6. The liner of claim 1, wherein the first portion prevents the passage of at least one of oxygen, rodents, odor, light, and moisture better than the second portion.

7. The liner of claim 1, wherein the first portion comprises at least two more plies than the second portion.

8. The liner of claim 1, wherein the first portion comprises at least three more plies than the second portion.

9. The liner of claim 1, wherein the first portion comprises at least four more plies than the second portion.

10. The liner of claim 1, wherein at least one ply of the first portion or at least one ply of the second portion includes a double wound film.

11. The liner of claim 1, wherein at least one ply of the first portion or at least one ply of the second portion includes a laminated ply.

12. The liner of claim 1, wherein at least one ply of the first portion or at least one ply of the second portion includes a coextruded ply.

13. The liner of claim 1, wherein the at least one strip provides flex crack resistance properties to the first portion.

14. The liner of claim 13, wherein the at least on strip provides flex crack resistance properties to the first portion in an area thereof proximate the fitment.

15. The liner of claim 14, wherein the second portion comprises a second strip located between plies of the second portion, and wherein a second fitment is positioned on the second portion and through the second strip, wherein the liner is drainable between the first and second portions through the fitment.

16. The liner of claim 15, wherein the second strip provides flex crack resistance properties to the second portion.

17. The liner of claim 16, wherein the second strip provides flex crack resistance properties to the second portion in an area thereof proximate the second fitment.

18. The liner of claim 1, wherein at least one of the strips comprises Nylon/ethylene vinyl alcohol.

19. The liner of claim 1, wherein at least one of the portions comprises a metallized polyester laminate layer.

20. The liner of claim 1, wherein external layers of the first and second portions comprise a metallized polyester laminate layer.

* * * * *